US011387591B2

(12) United States Patent
Lötkemann et al.

(10) Patent No.: US 11,387,591 B2
(45) Date of Patent: Jul. 12, 2022

(54) PLUG CONNECTOR MODULE FOR AN INDUSTRIAL PLUG CONNECTOR

(71) Applicant: HARTING ELECTRIC GMBH & CO. KG, Espelkamp (DE)

(72) Inventors: Irina Lötkemann, Espelkamp (DE); Bernard Schlegel, Rahden (DE); Heiko Meier, Minden (DE); Wilhelm Kliever, Minden (DE)

(73) Assignee: Harting Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 17/255,345

(22) PCT Filed: Jun. 13, 2019

(86) PCT No.: PCT/DE2019/100545
§ 371 (c)(1),
(2) Date: Dec. 22, 2020

(87) PCT Pub. No.: WO2020/001687
PCT Pub. Date: Jan. 2, 2020

(65) Prior Publication Data

US 2021/0273370 A1 Sep. 2, 2021

(30) Foreign Application Priority Data

Jun. 26, 2018 (DE) ..... 10 2018 115 371.6

(51) Int. Cl.
*H01R 13/648* (2006.01)
*H01R 13/514* (2006.01)
(Continued)

(52) U.S. Cl.
CPC ..... *H01R 13/514* (2013.01); *H01R 13/518* (2013.01); *H01R 13/659* (2013.01)

(58) Field of Classification Search
CPC ..... H01R 13/514; H01R 13/518; H01R 13/6581; H01R 13/659
(Continued)

(56) References Cited

U.S. PATENT DOCUMENTS 6,193,500 B1 2/2001 Yamashita et al.
2004/0053534 A1 3/2004 Beneke et al.
(Continued)

FOREIGN PATENT DOCUMENTS

CN 201417871 Y 3/2010
CN 202513380 U 10/2012
(Continued)

OTHER PUBLICATIONS

Chinese Office Action, dated Aug. 25, 2021, for Chinese Application No. 201980041898.8, 12 pages.
(Continued)

*Primary Examiner* — Khiem M Nguyen
(74) *Attorney, Agent, or Firm* — Seed IP Law Group LLP

(57) ABSTRACT

A plug connector module is provided for a modular industrial plug connector, wherein the plug connector module is formed from at least two independent functional units. In order to fit a holding frame with a plug connector module, a first functional unit is first of all combined with at least one second functional unit so as to form a plug connector module, and the plug connector module is then inserted into the holding frame.

11 Claims, 7 Drawing Sheets

(51) Int. Cl.
*H01R 13/518* (2006.01)
*H01R 13/659* (2011.01)

(58) Field of Classification Search
USPC ..... 439/607.23, 709, 710
See application file for complete search history.

(56) References Cited

U.S. PATENT DOCUMENTS

| | | | |
|---|---|---|---|
| 2004/0072472 | A1 | 4/2004 | Barry et al. |
| 2017/0117655 | A1 | 4/2017 | Meier et al. |

FOREIGN PATENT DOCUMENTS

| | | | |
|---|---|---|---|
| CN | 202749587 | U | 2/2013 |
| DE | 202 14 132 | U1 | 1/2003 |
| DE | 10 2014 108 847 | A1 | 12/2015 |
| DE | 10 2016 223 955 | A1 | 6/2018 |
| DE | 10 2016 223-995 | A1 | 6/2018 |
| DE | 10 2017 123 331 | B3 | 3/2019 |
| FR | 2 779 875 | A1 | 12/1999 |

OTHER PUBLICATIONS

International Preliminary Report on Patentability, dated Dec. 29, 2020; for International Application No. PCT/DE2019/100545, 10 pages.

European Patent Office, International Search Report and Written Opinion for international application No. PCT/DE2019/100545, dated Sep. 26, 2019, 15 pages (with English translation of International Search Report).

German Patent Office, Office Action for German application No. 10 2018 115 371.6 dated May 27, 2019, 8 pages.

Chinese Office Action, dated Mar. 9, 2022, for Chinese Application No. 201980041898.8, 12 pages.

PLUG CONNECTOR MODULE FOR AN INDUSTRIAL PLUG CONNECTOR

BACKGROUND

Technical Field

The disclosure relates to a plug connector module for an industrial plug connector and a method for fitting a holding frame with one or more plug connector modules.

Description of the Related Art

Plug connector modules are required as a constituent part of a plug connector modular system in order to be able to match a plug connector, in particular a heavy-duty industrial plug connector, to specific requirements in respect of signal and power transmission, for example between two electrical devices, in a flexible manner. To this end, plug connector modules are usually inserted into appropriate holding frames, which are also referred to as articulated frames, module frames or modular frames, amongst others. Therefore, the holding frames serve to receive a plurality of plug connector modules which are similar to one another and/or also different and to securely fasten said plug connector modules to a surface and/or a device wall and/or in a plug connector housing or the like.

In general, the plug connector modules each have a substantially cuboidal insulating body or a cuboidal housing. These insulating bodies or housings can serve, for example, as contact carriers and receive and fix contacts of very different kinds. The functioning of a plug connector formed in this way is therefore highly flexible. For example, pneumatic modules, optical modules, modules for transmitting electrical energy and/or electrical analog and/or digital signals can be received in the respective insulating body or housing and therefore used in the plug connector modular system. Plug connector modules increasingly perform measurement- and data-related tasks too.

Holding frames which are formed from two frame halves which are connected to one another in an articulated manner are optimally used. The plug connector modules are provided with approximately rectangular holder means or devices which project from the narrow sides. Recesses or openings which are designed as openings that are closed on all sides and which the holder means or devices enter when the plug connector modules are inserted into the holding frame are provided in the side parts of the frame halves. So-called articulated frames are used most frequently. For the purpose of inserting the plug connector modules, the holding frame 1 is folded open, i.e., opened, wherein the frame halves are folded open about the articulations only to such an extent that the plug connector modules can be inserted. The frame halves are then folded together, i.e., the holding frame is closed, wherein the holder means or devices enter the recesses and create secure, interlocking holding of the plug connector modules in the holding frame.

The above-described modular industrial plug connectors provide a high degree of flexibility and can be configured for a very wide variety of fields of use by way of plug connector modules with different functions being installed together in a common holding frame. However, the number of plug connector module spaces in a holding frame is limited. As a result, the flexibility of an industrial plug connector of this kind is limited.

The German Patent and Trade Mark Office has searched the following prior art in the priority application relating to the present application:

DE 10 2017 123 331 B3, DE 10 2014 108 847 A1 and DE 202 14 132 U1.

BRIEF SUMMARY

According to embodiments of the invention, a plug connector module is provided which expands the spectrum of use of an industrial plug connector.

The plug connector module according to embodiments of the invention is intended for use in a modular industrial plug connector. In this case, a plurality of similar and/or different plug connector modules are generally installed in a so-called holding frame. The holding frame is then subsequently installed in a plug connector housing or a device wall. The plug connector module according to embodiments of the invention is formed from at least two independent functional units.

A functional unit forms an independent component. This means that the functional unit can function independently, that is to say without a further functional unit connected to it. A functional unit is not rendered technically usable just by joining together two or more functional units to form a plug connector module.

A functional unit advantageously has at least one contact element and/or one sensor and/or one edge computer. The edge computer can collect, store, process and transmit data for example. The contact element may be, for example, an electrical contact element for power or signal transmission. The contact element may also be an optical contact element to which, for example, an optical waveguide is connected. A functional unit can have a plurality of contact elements, in particular also a plurality of different contact elements. For example, electrical and optical contact elements can be mixed with one another. The sensor may be, for example, a current sensor which monitors an adjacent contact element, for example arranged in an adjacent functional unit. However, temperature sensors, optical sensors, in particular scattered light sensors or other sensors, can also be provided. A functional unit can also contain a plurality of sensors, in particular also different sensors. A functional unit can also contain a sensor or a plurality of sensors and at the same time a contact element or a plurality of contact elements.

The functional units of a plug connector module can operate entirely independently of one another. However, the functional units may also experience a synergy effect due to the joining, in particular when sensors of one functional unit are combined with contact elements of another functional unit.

In an advantageous development of the invention, the plug connector module comprises or consists of a first functional unit and at least one second functional unit, wherein the first functional unit has another type of contact elements and/or a different number of contact elements and/or contact elements with a different cable connection technique to the second functional unit. For example, solid contact elements for transmitting power, for example for an electric motor, can be provided in a first functional unit. More delicate contact elements for signal transmission, for example for controlling said electric motor, can be present in the second functional unit which is connected to the first functional unit. The contact elements of the first functional unit can be electrically connectable to a conductor of a connected cable, for example using the so-called crimping technique. The contact elements of the second functional unit can be equipped, for example, with a so-called screw connection. In this way, different cable connection techniques can be realized within one plug connector module.

The individual functional units can be welded or adhesively bonded to one another to form a plug connector module for example. However, it is advantageous when a fastening means or device is integrally formed on the side wall of the functional unit, by way of which fastening means or device a first functional unit and a second functional unit can be reversibly fixed to one another. As a result, the functional units can be combined with one another in a simple manner and possibly also reused.

Advantageously, a first fastening means or device is integrally formed on a side wall of the first functional unit and a second fastening means or device is integrally formed on a side wall of the second functional unit, wherein the first and the second fastening means or devices are configured in a complementary manner to one another. As a result, reliable and primarily tool-free assembly of the plug connector module can be ensured. The contours of the fastening mean(s) or devices can be designed differently, so that only specific functional units can be combined with one another. For example, it makes no sense to combine an optical sensor of a first functional unit with an electrical contact element of a second functional unit. As a result, faulty assembly of a plug connector module can be pre-emptively prevented.

The functional unit may include a holder means or device on a side wall thereof for fixing the plug connector module in a holding frame. The holding frame which is completely fitted with plug connector modules can be installed in an industrial plug connector. In general, a first functional unit has a first holder means or device on a side wall and a second functional unit has a second holder means or device on a side wall. The holder means or devices then engage in corresponding openings of a holding frame, for fixing the plug connector module in the holding frame, as already described above.

The fastening means or devices and the holder means or devices are arranged on opposite side walls of the functional unit. The first and the second holder means or devices may have a different geometry. The openings in the holding frame are matched to the respective geometry. As a result, the orientation of the plug connector module, the so-called polarization, is defined. This measure facilitates the assembly of an industrial plug connector comprising the plug connector modules according to embodiments of the invention.

In a particularly advantageous embodiment of the invention, the plug connector module has a shielding element, wherein the shielding element, for electromagnetic shielding, is arranged between two adjacent functional units. The shielding element is formed from a metal material, in particular a sheet metal. If, for example, signal contact elements are arranged in the functional units, so-called crosstalk of the signal contact elements is prevented by the shielding. As a result, the plug connector module provides good signal integrity.

The plug connector module may also include a strain-relief element. The strain-relief element prevents excessively high transverse forces acting on the plug connector module, as a result of which the functional units could otherwise be torn apart. The strain-relief element can be arranged between two adjacent functional units and can form a functional unit with the shielding element for example.

The way in which a holding frame is fitted with a plug connector module according to embodiments of the invention is described below:

First, a first functional unit is combined with at least one second functional unit to form a plug connector module. The plug connector modules produced in this way can then be inserted into a holding frame. If the holding frame is a so-called articulated frame, the frame halves of the holding frame are folded open and the combined plug connector module is then inserted between the frame halves. This process can be repeated until the capacity of the holding frame for receiving plug connector modules is exhausted. However, insertion spaces can also remain free in a holding frame in order to be able to possibly retrofit yet further plug connector modules later if, for example, a machine is technically upgraded. Plug connector modules which are constructed from functional units can be used when fitting the holding frame. However, commercially available plug connector modules which do not consist of functional units of this kind can also be used. Depending on the proportion of holding frames which comprise plug connector modules consisting of functional units, the first method step "combining" has to be carried out n times. The method step "inserting" takes place m times analogously to the total number of plug connector modules. The numbers n and m originate from the set of natural numbers, wherein n is less than or equal to m.

Openings are respectively provided in the respective frame halves, the holder means or devices of the plug connector module(s) entering said openings during insertion. When the frame halves are folded together, the holder means or devices enter the openings completely, as a result of which interlocking holding of the plug connector module or of the plug connector modules in the holding frame is produced.

Conductors of a generally multi-core cable are respectively connected to the individual plug connector modules. After the holding frame has been fitted with a desired number of plug connector modules, said holding frame is installed in a plug connector housing of an industrial plug connector.

BRIEF DESCRIPTION OF THE SEVERAL VIEWS OF THE DRAWINGS

Embodiments of the invention are illustrated in the drawings and will be explained in more detail below. In the drawings.

The figures may contain partially simplified, schematic illustrations. In some cases, identical reference signs are used for similar, but not necessarily identical, elements. Various views of similar elements may be shown at different scales.

DETAILED DESCRIPTION

Figure 1:
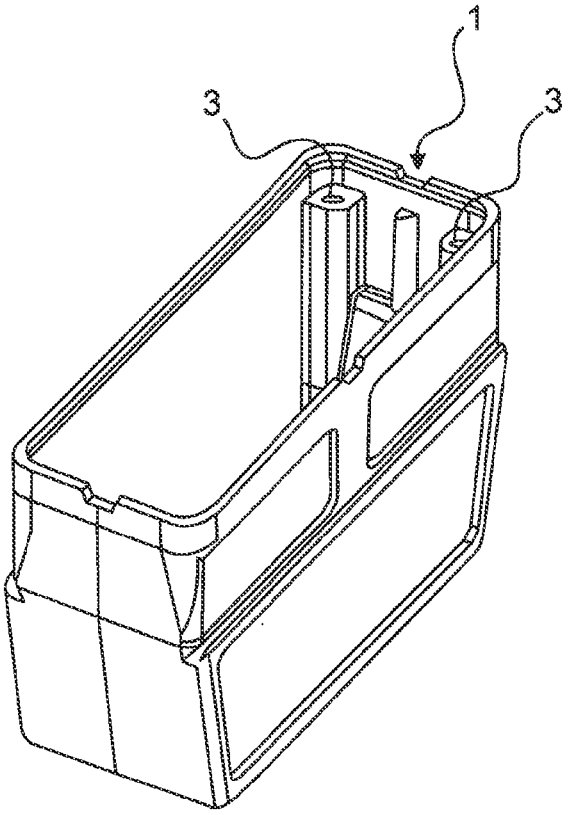
FIG. 1 shows a perspective illustration of a plug connector housing of an industrial plug connector.

FIG. 1 shows a plug connector housing 1 of an industrial plug connector. The plug connector housing 1 generally consists of a metal material and is produced, in particular, using a zinc die-casting process. A plug connector housing 1 of this kind is robust and has good electromagnetic shielding properties and is therefore particularly suitable for harsh industrial environments.

Figure 2:
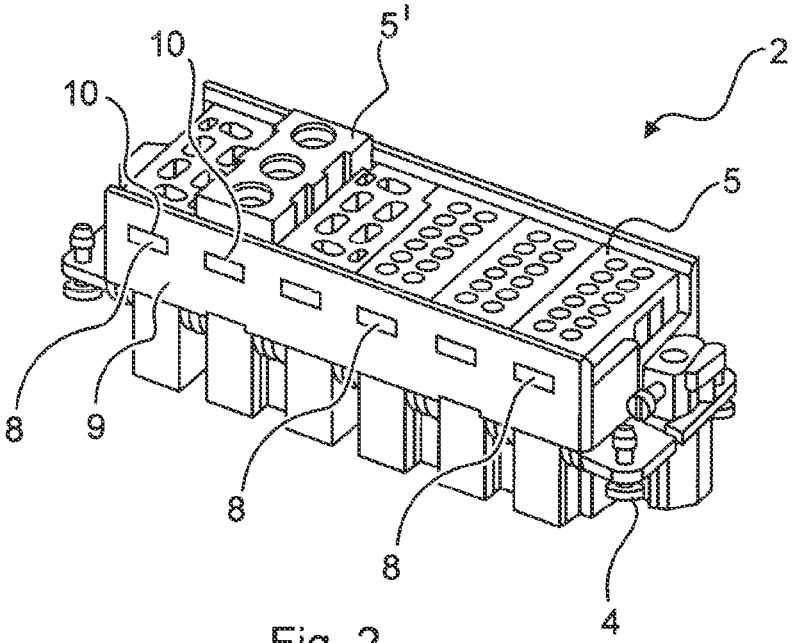
FIG. 2 shows a perspective illustration of a holding frame which is fitted with various plug connector modules.

FIG. 2 shows a holding frame 2 which is fitted with various plug connector modules 5, 5'. The holding frame 2 has a frame-like design and has screws 4 at each of its corner regions. The plug connector housing 1 has an approximately rectangular cross section and has corresponding threaded bores 3 in the corner regions of the housing interior. The holding frame 2 can be fastened in the plug connector housing 1 by way of the screws 4, in interaction with the associated threaded bores 3.

Figure 3:
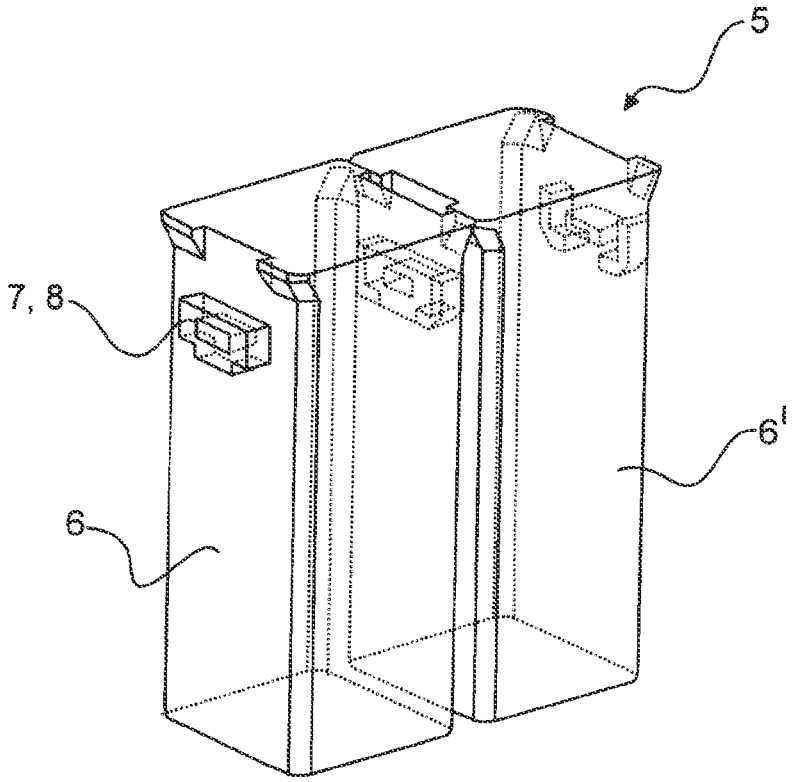
FIG. 3 shows a perspective and partially transparent illustration of a first exemplary embodiment of a plug connector module according to the invention.
Figure 4:
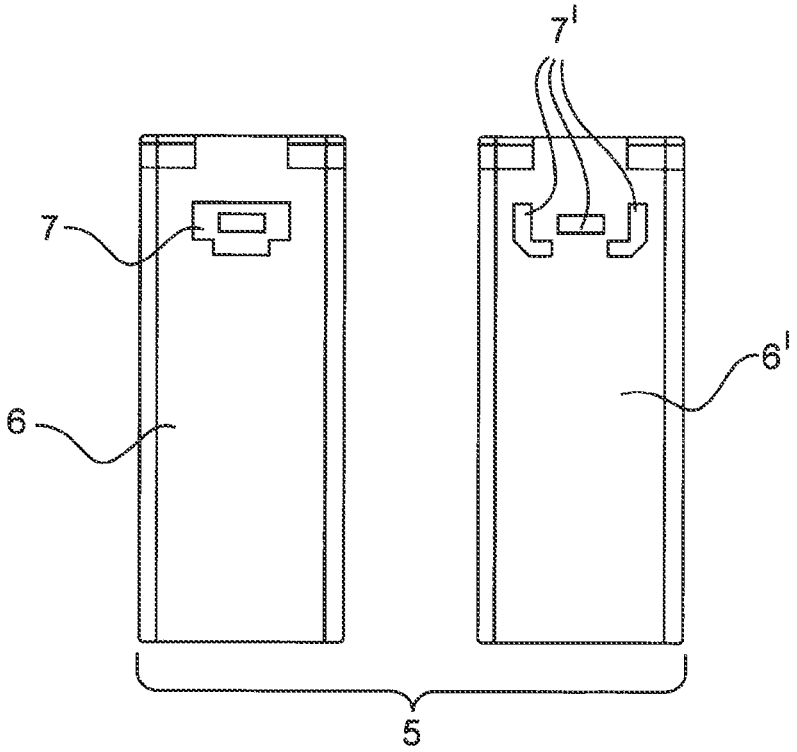
FIG. 4 shows a side view of two functional units which, when combined, form the first exemplary embodiment of the plug connector module according to embodiments of the invention.

FIGS. 3 and 4 show a first embodiment of a plug connector module 5 according to the invention. The plug connector module 5 consists of two functional units 6, 6' which are reversibly connected to one another. The functional units 6, 6' butt at a plane parallel to the plugging direction SR of the plug connector module 5. The functional units 6, 6' according to this embodiment of the invention produce transverse division of the plug connector module 5. Each functional unit 6, 6' functions independently with respect to its transmission properties and/or sensor properties. This means that the first sensor unit 6 can transmit, for example, power, data and/or signals, without being connected to the second functional unit 6'. This is also the case the other way around.

Contact elements and/or sensors (not shown for reasons of illustration), in any desired number in each case, are respectively arranged in the individual functional units 6, 6'. A first fastening means or device 7 is integrally formed on a side wall of the first functional unit 6. A matching second fastening means or device 7' is integrally formed on a side wall of the second functional unit 6'. The first and the second fastening means 7, 7' are configured in a complementary manner to one another. In the exemplary embodiment shown here, fastening means or devices 7, 7' are respectively integrally formed on two opposite side walls of the respective functional units 6, 6'. The fastening means or devices 7, 7' shown here have an outer geometry of the kind that such they can simultaneously serve as the holder means or device already mentioned above in order to fasten the plug connector module 5 in a holding frame 2. The fastening means or devices 7, 7' shown here have a dual function as it were and are therefore provided with the reference signs 7 and 8 in FIG. 3 at the same time.

Figure 5:
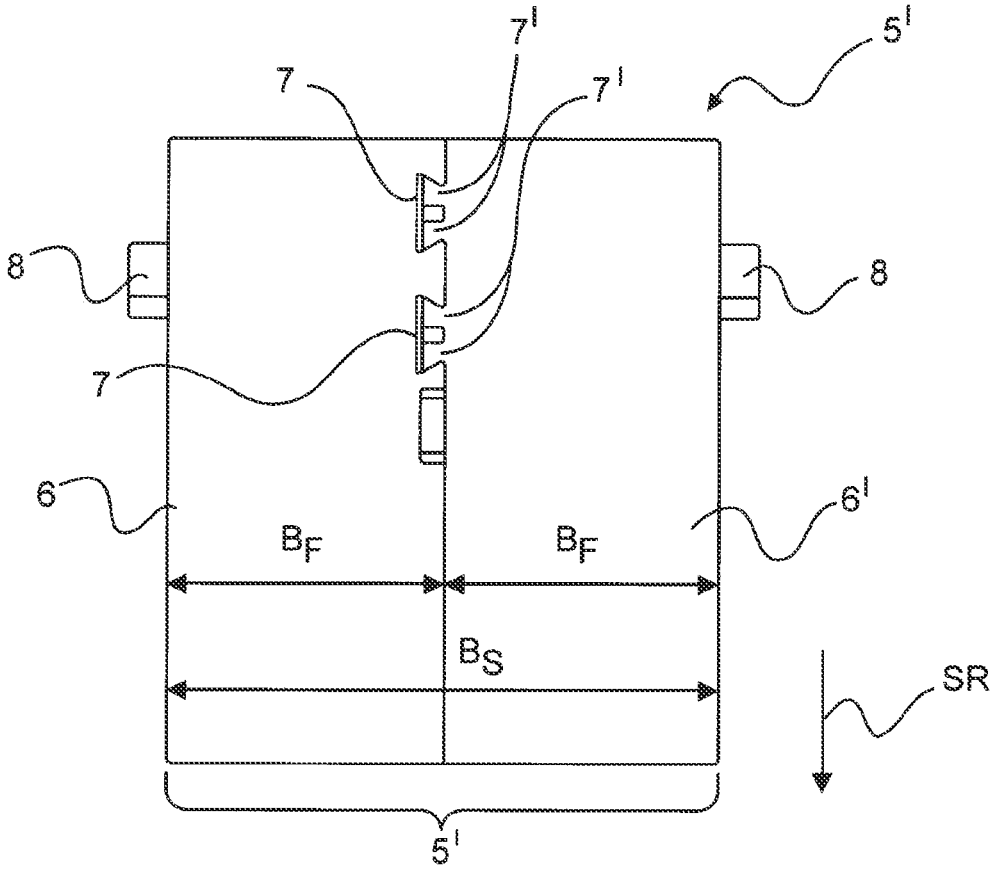
FIG. 5 shows a side view of a second exemplary embodiment of the plug connector module according to the invention.
Figure 6:
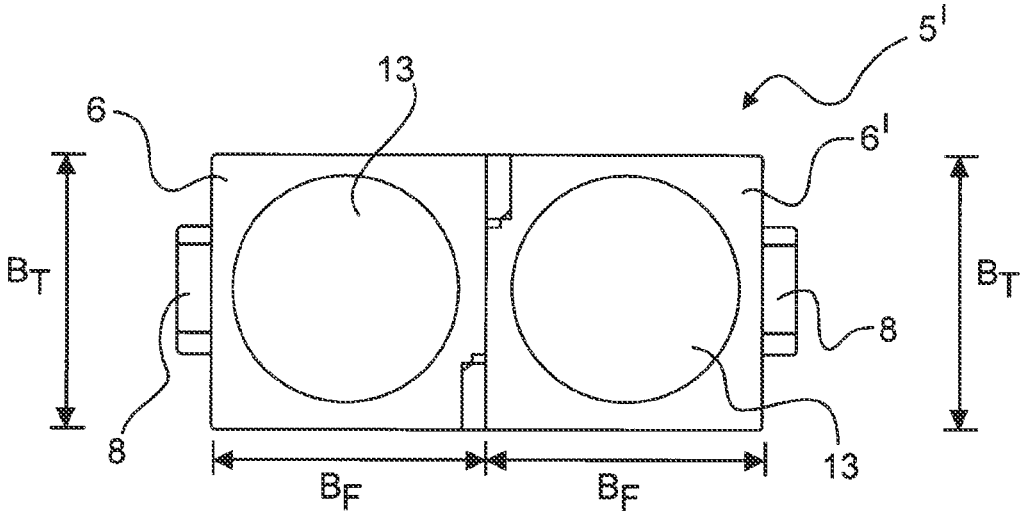
FIG. 6 shows a plan view of the second exemplary embodiment of the plug connector module according to the invention.

FIGS. 5 and 6 show a second exemplary embodiment of the plug connector module 5' according to the invention. The plug connector module 5' shown here also comprise or consist of a first functional unit 6 and a second functional unit 6' which are each independent in respect of their technical manner of operation. A fastening means or device 7, 7' is respectively integrally formed on a side surface of the functional units 6, 6'. The fastening means or device 7 of the first functional unit 6 is designed substantially as a recess. The fastening means or device 7' of the second functional unit 6' has a dovetail shape which matches the recess. This so-called dovetail connection has been found to be a particularly stable manner of fixing the functional units 6, 6' since it can withstand high transverse forces. The dovetail connection is also reversible, and therefore the functional units 6, 6' can be reused and/or combined in a different way. A holder means or device 8 is respectively integrally formed on the opposite side surface of the functional units 6, 6'.

FIG. 5 illustrates a sectional illustration of the plug connector module 5' in a plane in the plugging direction SR. It can be seen in said Figure that the width $B_S$ or the width of the broad side of the plug connector module 5' is composed of the width $B_F$ of two functional units 6 ($B_S=B_F+B_F \Leftrightarrow BF=2BF$). FIG. 6 illustrates a sectional illustration of the plug connector module 5' in a plane transverse to the plugging direction SR. The depth $B_T$ or the width of the narrow side of the plug connector module 5' is marked here. The width $B_T$ of the plug connector module 5' corresponds to the width of the functional unit 6. Owing to the above-described transverse division of the plug connector module 5 into two functional units 6, 6', a virtually square cross section of the individual functional units 6, 6' is achieved. Virtually square means that the depth $B_T$ of the functional units 6, 6' corresponds approximately to the width $B_F$ of the functional units 6, 6'. The difference in length between the depth $B_T$ of the functional units 6, 6' and the width $B_F$ of the functional units 6, 6' is less than or equal to 10 percent ($\leq 10\%$).

Contact elements with a large cross section or diameter can also be used owing to transverse division of the plug connector modules 5, 5' . . . of this kind. FIG. 6 shows two functional units 6, 6' which have openings 13 with a large diameter, for receiving contact elements with a correspondingly large cross section or diameter. Contact elements of this kind could no longer be used in the case of longitudinal division of the plug connector module 5'.

The holding frame 2 consists of two frame halves are 9 which are connected to one another in an articulated manner. Openings 10 are respectively provided in the respective frame halves 9 of the holding frame 2, the holder means or devices 8 of the plug connector module 5, 5' or of the plug connector modules 5, 5' entering said openings during insertion. When the frame halves are 9 are folded together, the holder means or devices 8 enter the openings 10 completely, as a result of which interlocking holding of the plug connector module 5, 5' or of the plug connector modules 5, 5' is produced in the holding frame 2. The holder means or devices 8 have different dimensions. The associated openings 10 are adapted in a corresponding manner, so that so-called polarization is created by way of the holder means or devices 8. The plug connector modules 5, 5', 5'', . . . can be inserted into the holding frame 2 only with a specific orientation.

Figure 7:
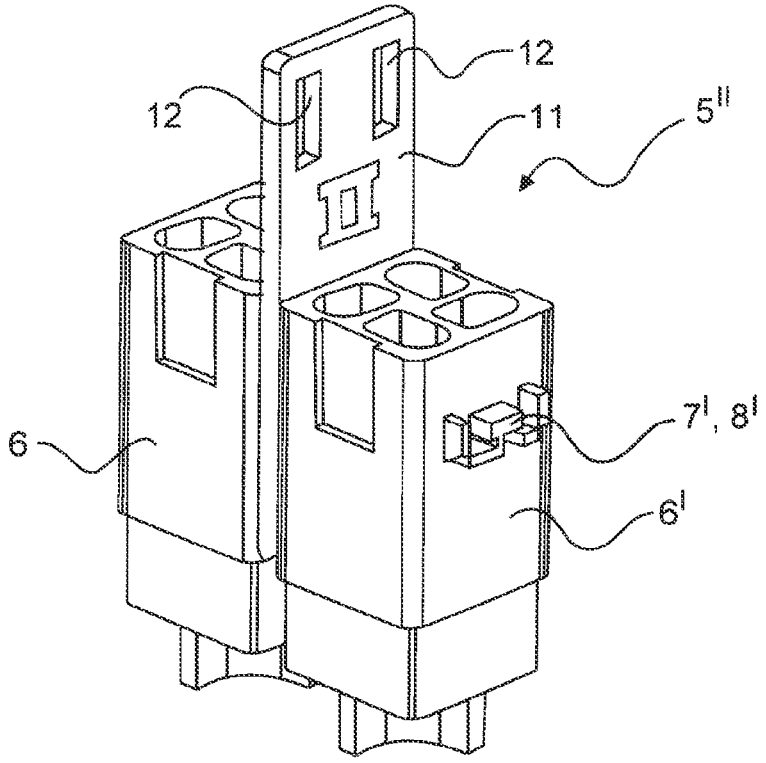
FIG. 7 shows a perspective illustration of a third exemplary embodiment of the plug connector module according to the invention, FIGS. 8-15 each show two functional units which, when combined, form further exemplary embodiments of the plug connector module according to the invention.

FIG. 7 illustrates a third variant embodiment of the plug connector module 5" according to the invention. The plug connector module 5" consists of two functional units 6, 6' and is equipped with the same fastening means or devices 7, 7' or holder means or devices 8, 8' as the first embodiment. Here too, the fastening means or devices 7, 7' for reversibly fixing the functional units perform the function of holder means or devices 8, 8' for fixing the plug connector module 5" in a holding frame 2 at the same time. The plug connector module 5" has a strain-relief element 11 which is arranged between the functional units 6, 6'. The strain-relief element 11 has two openings 12 on the cable connection side. A cable tie (not shown) for fixing and strain relief of a cable (not shown) which is connected to the plug connector module 5" can be passed through the openings 12. The strain-relief element 11 is equipped with a further opening (not shown for reasons of illustration) between the functional units 6, 6', so that the fastening means or devices 7, 7'—for fixing the functional units 6, 6'—can interengage. Owing to the strain-relief element 11, the plug connector module 5" is somewhat wider, and therefore it is more tightly clamped by the frame halves 9 of the holding frame 2 in the installed state. As a result, a shear movement of the functional units 6, 6' of the plug connector module 5" is effectively prevented. The strain-relief element 11 can be manufactured from a metal material and therefore also provide electromagnetic shielding of the two functional units 6, 6' from one another.

Figure 8:
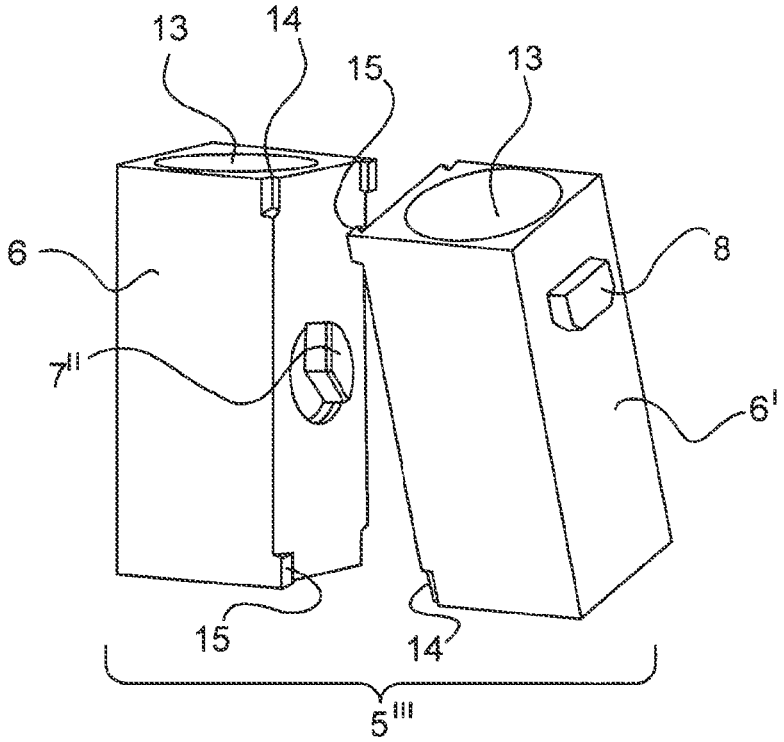

FIG. 8 shows a further exemplary embodiment of a plug connector module 5'" according to the invention. FIG. 8 shows two functional units 6, 6' which have, as fastening means or devices 7", a partially circular contour and a corresponding receptacle for it. The functional units 6, 6' can be reversibly connected to one another by way of a rotational movement. The rotational movement ends as soon as a stop contour 15 of a functional unit 6, 6' opens into the recess 14 of the other functional unit 6, 6', which recess is provided for said stop contour, and latches there.

Figure 9:
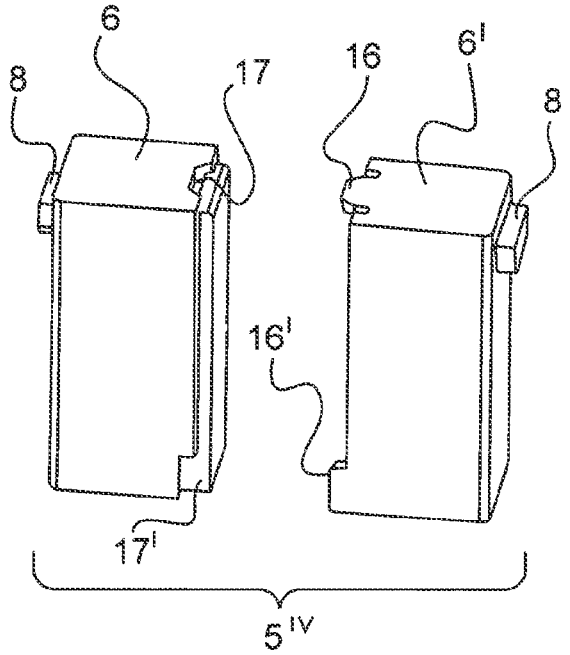
Figure 10:
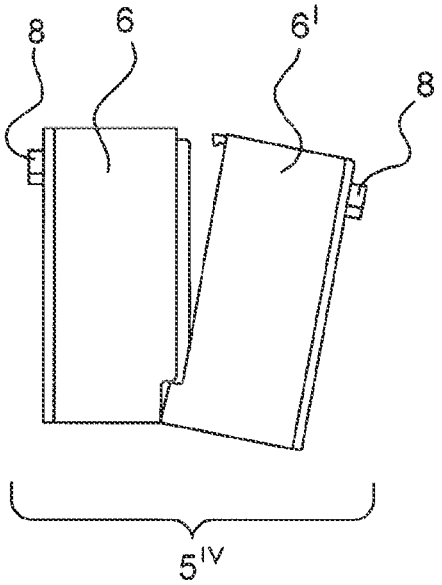

FIGS. 9 and 10 show a further exemplary embodiment of a plug connector module $\mathbf{5}^{IV}$ according to the invention. Said figures show two further functional units 6, 6' which can be reversibly latched to one another by way of latching contours 16 and corresponding recesses 17 by way of a tilting movement.

Figure 11:
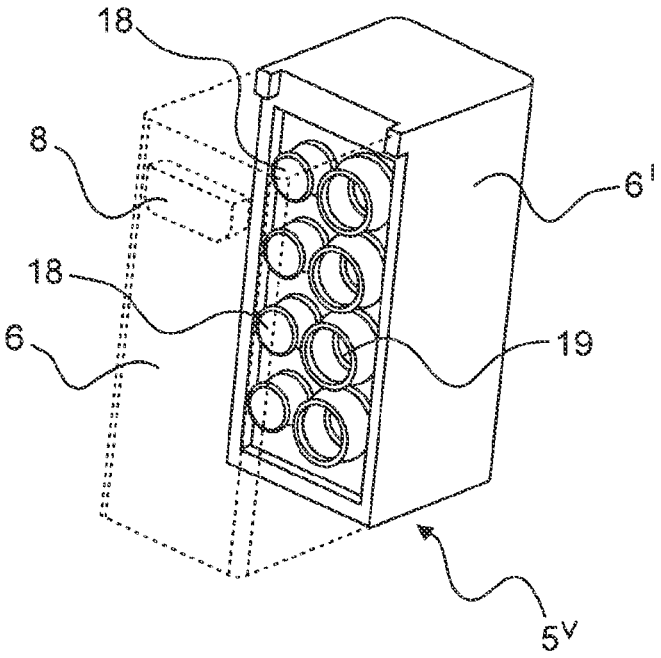

FIG. 11 shows a further exemplary embodiment of a plug connector module $\mathbf{5}^{V}$ according to the invention. One functional unit 6 is illustrated in a transparent manner for reasons of illustration. The functional units 6, 6' each have studs 18 and sockets 19 on the facing sides and can be reversibly latched to one another in accordance with the Lego principle.

Figure 12:
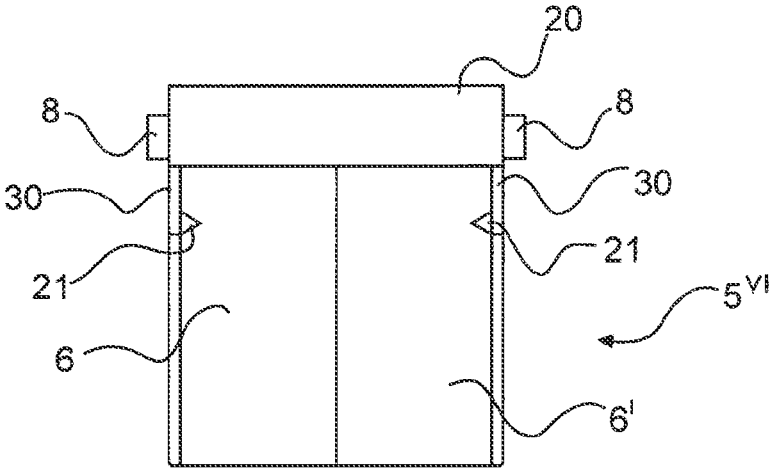

FIG. 12 shows a further exemplary embodiment of a plug connector module $\mathbf{5}^{VI}$ according to the invention. The functional units 6, 6' can be reversibly connected to one another by way of a frame-like latching plate 20. The latching plate 20 has a latching arms 30 which point in the plugging direction and have end-side latching hooks 21 which engage into recesses of the functional units 6, 6', which recesses are provided for them. The holder means or devices 8 are integrally formed on the latching plate 20. Accordingly, the above-described polarization of the plug connector modules $\mathbf{5}^{VI}$ is realized by way of the latching plate 20 when said plug connector modules are inserted into the holding frame 2. Therefore, the individual functional units 6, 6' do not need to contain any polarization means and can be permutated with one another as desired. The latching plate 20 may consist of an elastic, metal material and can therefore also perform a shielding or grounding function in parallel.

Figure 13:
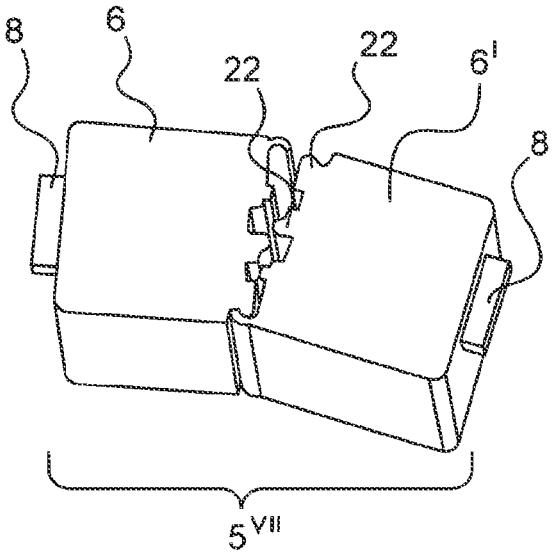
Figure 14:
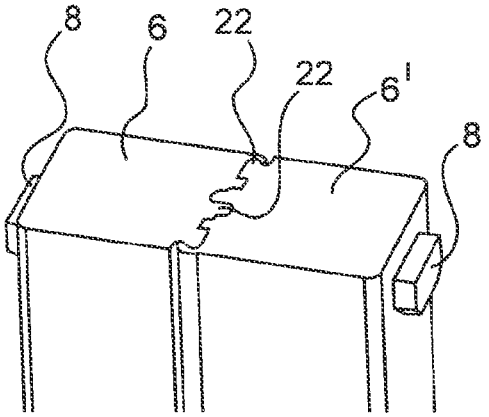

FIGS. 13 and 14 show a further exemplary embodiment of a plug connector module $\mathbf{5}^{VII}$ according to the invention. The two functional units 6, 6' can be reversibly latched to one another by way of a complex structure 22.

Figure 15:
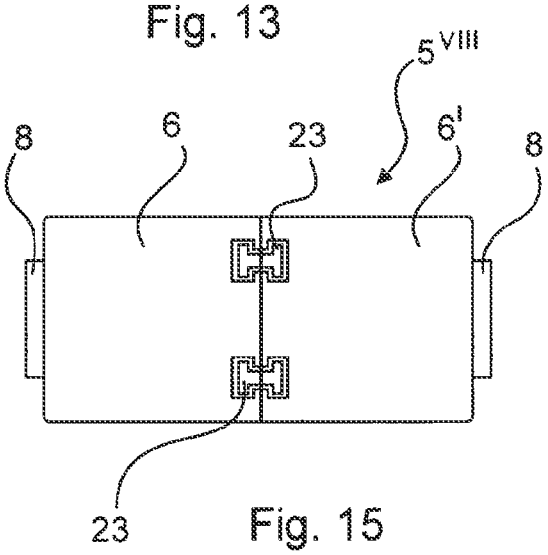
Figure 16:
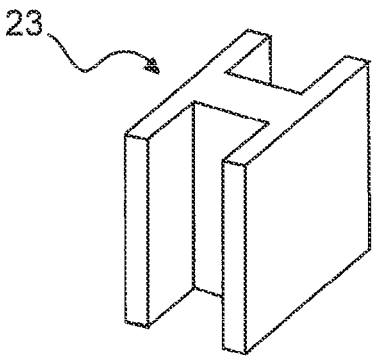
FIG. 16 shows a connecting means or devices for two functional units, and FIGS. 17 and 18 each show two functional units which, when combined, form further exemplary embodiments of the plug connector module according to the invention.

FIG. 15 shows a further exemplary embodiment of a plug connector module $\mathbf{5}^{VIII}$ according to the invention. The two functional units 6, 6' are reversibly connected to one another by way of a separate connecting means or device 23, shown in FIG. 16. The functional units 6, 6' have T-shaped grooves on their connecting surface, it being possible for the double-T-carrier-like connecting means or device 23 to be pushed into said slots.

Figure 17:
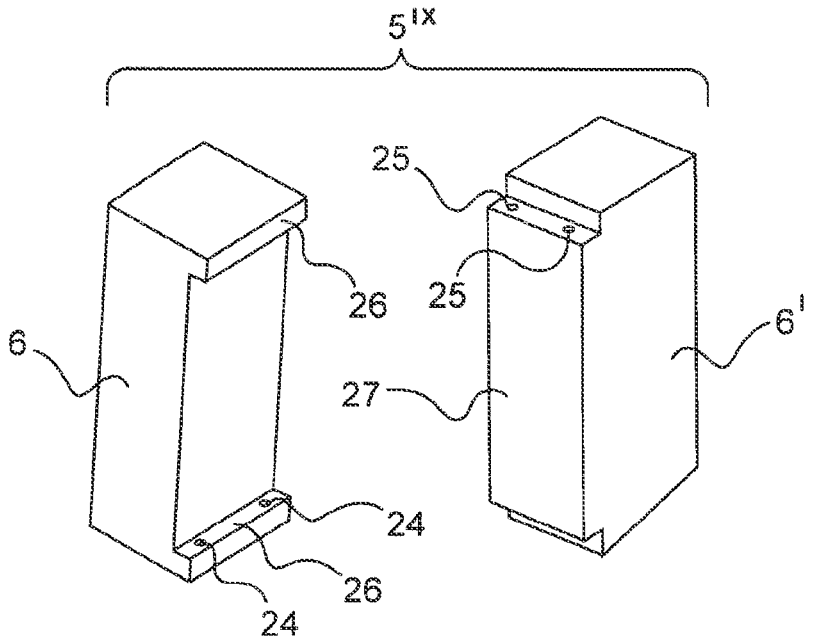

FIG. 17 shows a further exemplary embodiment of a plug connector module $\mathbf{5}^{IX}$ according to the invention. The first functional unit 6 has, in each of the end regions, outwardly pointing webs 26 with respectively internal recesses 24. The second functional unit 6' has a box contour 27 which fits between the webs 26. Pins 25, which match the recesses 24 of the webs 26, are integrally formed on the end regions of the box contour 27. The pins 25 engage into the recesses 24 when the functional units 6, 6' are brought together, as a result of which reversible fixing of the functional units 6, 6' to one another is realized.

Figure 18:
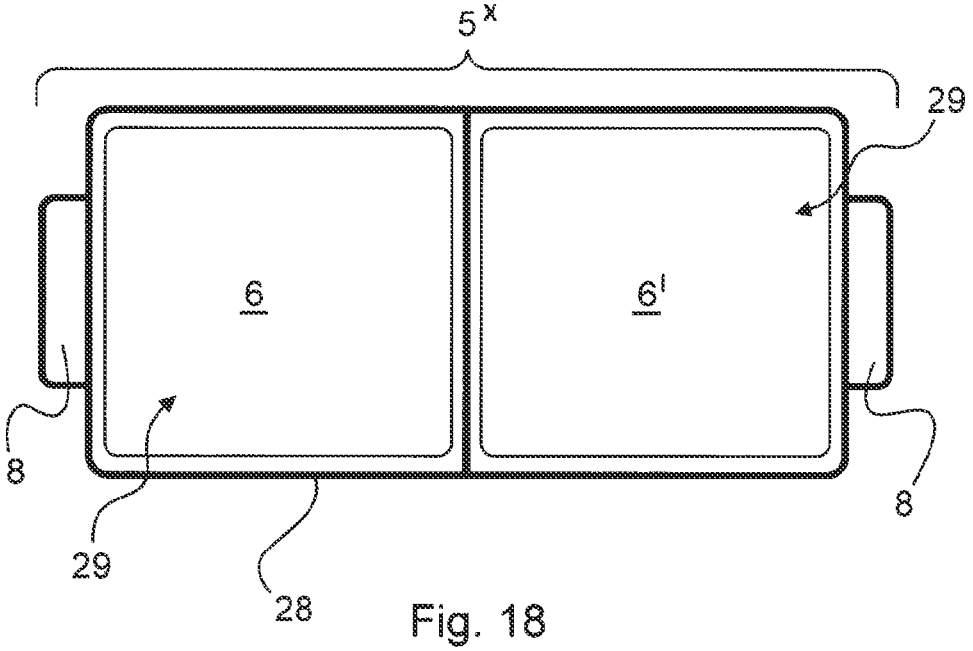

FIG. 18 shows a further exemplary embodiment of a plug connector module $\mathbf{5}^{X}$ according to the invention. Said Figure shows the cross section of a plug connector module $\mathbf{5}^{X}$ from above. The plug connector module $\mathbf{5}^{X}$ shown here consists of a framework 28 on which holder means or devices 8 for installation into a holding frame 2 are already integrally formed. The framework 28 has two receiving regions 29 for in each case one functional unit 6, 6'. There are no holder means or devices 8 integrally formed on the functional units 6, 6' themselves. As a result, the functional units 6, 6' can be inserted into the receiving regions 29 in a flexible manner.

Even though various aspects or features of the invention are shown respectively in combination in the figures, it is clear to the person skilled in the art—unless stated otherwise—that the illustrated and discussed combinations are not the only ones possible. In particular, mutually corresponding units or feature complexes from different exemplary embodiments can be exchanged with one another.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A plug connector module for a modular industrial plug connector having a holding frame, the plug connector module comprising:

at least two independent functional units that are coupleable together to form a combined module unit that is removably receivable in the holding frame, and wherein a first functional unit and a second functional unit of the at least two independent functional units of the combined module unit include at least one different type of functional element from each other, the first functional unit comprising at least one functional element in the form of an electrical contact element, and the second functional unit comprising at least one functional element in the form of a sensor or an optical contact.

2. The plug connector module as claimed in claim 1, wherein, for each functional unit, a fastening means is integrally formed on a side wall of the functional unit by which the first functional unit and the second functional unit of the at least two independent functional units of the combined module unit can be reversibly fixed to one another.

3. The plug connector module as claimed in claim 2, wherein a first fastening means is integrally formed on a side wall of the first functional unit and a second fastening means is integrally formed on a side wall of the second functional unit, wherein the first and the second fastening means are configured in a complementary manner to one another.

4. The plug connector module as claimed in claim 1, wherein each functional unit has a holder means on a side wall thereof for fixing the plug connector module in the holding frame.

5. The plug connector module as claimed in claim 4, wherein:

the first functional unit has a first holder means on a side wall and the second functional unit has a second holder means on a side wall, and the first and second holder means can each enter openings of the holding frame, for fixing the plug connector module in the holding frame.

6. The plug connector module as claimed in claim 5, wherein the first and the second holder means have a different geometry.

7. The plug connector module as claimed in claim 1, wherein the plug connector module has a shielding element for electromagnetic shielding, and wherein the shielding element is arranged between two adjacent functional units of the at least two independent functional units.

8. The plug connector module as claimed in claim 1, wherein the plug connector module has a strain-relief element.

9. A method for fitting a holding frame with a plug connector module, the method comprising:

initially combining a first functional unit with at least one second functional unit to form a plug connector module; and thereafter, inserting the plug connector module into the holding frame, wherein the first functional unit and the second functional unit include at least one different type of functional element from each other, the first functional unit comprising at least one functional element in the form of an electrical contact element, and the second functional unit comprising at least one functional element in the form of a sensor or an optical contact.

10. The method as claimed in claim 9, further comprising:

folding open frame halves of the holding frame before the insertion of the plug connector module into the holding frame between the frame halves;

arranging the plug connector module such that holder means of the plug connector module are aligned with openings provided in the frame halves during the insertion; and folding the frame halves together, as a result of which the holder means enter the openings completely and interlocking holding of the plug connector module in the holding frame is thereby produced.

11. The method as claimed in claim 9, wherein:

the combining is repeated n times and the inserting is repeated m times, wherein n and m are natural numbers and the number n is less than or equal to the number m, as a result of which the holding frame is fitted with similar and/or different plug connector modules one after the other.

* * * * *